United States Patent [19]

Loebach

[11] Patent Number: 4,863,421

[45] Date of Patent: Sep. 5, 1989

[54] FOLDING APPARATUS

[76] Inventor: Michael H. Loebach, R.D. No. 3, Box 93, Fort Plain, N.Y. 13339

[21] Appl. No.: 54,389

[22] Filed: May 26, 1987

[51] Int. Cl.[4] ..... B31F 1/00

[52] U.S. Cl. ..... 493/419; 493/441; 493/442

[58] Field of Search ..... 493/417, 419, 422–425, 493/434, 435, 436, 441, 442, 454, 249, 420

[56] References Cited

U.S. PATENT DOCUMENTS

| | | | |
|---|---|---|---|
| 473,068 | 4/1892 | Fowler | 493/419 |
| 1,781,768 | 11/1930 | Spiess | 493/419 |
| 3,097,578 | 7/1963 | Winkler et al. | 493/419 |
| 3,190,640 | 6/1965 | Sjostrom | 493/422 |
| 4,493,690 | 1/1985 | Niemiro et al. | 493/454 |

OTHER PUBLICATIONS

"Web Offset Press Operating", by Edward J. Kelly, 1974, Publisher—Graphic Arts Technical Foundation, pp. 64, 67 and 68.

*Primary Examiner*—Frederick R. Schmidt
*Assistant Examiner*—Robert Showalter
*Attorney, Agent, or Firm*—Brumbaugh, Graves, Donohue & Raymond

[57] ABSTRACT

A folding apparatus in which an intermediate span of a signature at the folding station is buckled by a pair of oppositely driven signature feeding surfaces into the nip of a pair of converging signature folding and feeding surfaces which fold the signature and feed it from the folding station.

13 Claims, 4 Drawing Sheets

FOLDING APPARATUS

BACKGROUND OF THE INVENTION

This invention relates to a folding apparatus for printing signatures and, more particularly, to a folding apparatus in which a printed signature is fed to a folding station situated between a pair of converging signature folding and feeding surfaces adjacent one side of the signature and a pair of oppositely driven signature feeding surfaces adjacent the other side of the signature. The pair of oppositely driven signature feeding surfaces engage the signature at spaced apart points and feed the intermediate portion of the signature between the pair of converging signature folding and feeding surfaces which fold the signature and discharge it from the folding station.

Although the folding apparatus of the present invention has a more general application, it is particularly adapted to produce "chop" folds in printed signatures, that is to say, a fold that is perpendicular to a signature that has already been jaw folded.

BRIEF DESCRIPTION OF THE PRIOR ART

Printed signatures are often "jaw" folded across the width of the signature and then "chop" folded along a line perpendicular to the jaw fold. The jaw fold is made by a tucker blade carried by one cylinder and a jaw carried by an adjacent cylinder. The paper is fed between the tucker blade and the jaw, and the jaw imparts a crease or fold line into the signature.

If the jaw folded signature is to be chop folded, the jaw folded signature is fed to a chop folding station situated above a pair of converging signature folding and feeding surfaces and below a chopper blade which descends, forcing the signature into the nip between the pair of converging signature folding and feeding surfaces which fold the signature and discharge it from the folding station.

Chopper blades have long been used for producing chop folds, but they have many drawbacks, inter alia, the folds which they produce are not accurate and precise, they do not lend themselves to high speed operation, they tend to damage the signature and they give rise to design and critical adjustment problems.

The chopper blade feeds the signature into the nip of the signature folding and feeding surfaces by rapidly descending against the signature in the folding station, and the signature is free to move or slip relative to the blade because there is no provision for controlled feeding of the signature into the nip. Such undesirable movement or slipping of the signature relative to the blade will cause defective folding of the signature.

The limitations in speed of operation are due to the relatively heavy mass of the chopper blade and the driving mechanism which imparts reciprocating motion to the blade. The blade must be relatively heavy and massive to overcome the high forces encountered by it, and there is a limitation on the speed at which the drive mechanism can reciprocate the chopper blade.

The conventional reciprocating blade chop folding apparatus damages the signatures, for example, by imparting crumpled edges and "dog ears", due to the action of the blade and signature folding and feeding surfaces on the signature. Ideally, the blade should push the signature into the nip gradually, but in practice the blade must be designed to accelerate the signature to a velocity above that of the folding and feeding surfaces.

As the blade slows down before it reverses direction, the signature is thrust into the nip, abruptly decelerating the leading edge of the signature while the trailing ends attempt to overrun the leading edge, thereby resulting in the crumpled edges and "dog ears". In conventional chop folding apparatus, the signature can also be damaged by the stops used to stop and register the signatures at the folding station. Brushes are sometimes used to slow the signature before it encounters the stops. However, the design and adjustment of the slowdown brushes is critical and can result in jam-ups.

Moreover, in conventional chop folding apparatus, the adjustment of the nip of the signature folding and feeding surfaces is critical. Since the chopper blade thrusts the signature into the nip, the nip must be carefully designed and adjusted to catch the signature and draw it into the nip. This critical adjustment must be changed with changes in the thickness of the signature to be folded. Failure to make the adjustment with precision will cause problems.

BRIEF DESCRIPTION OF THE INVENTION

The folding apparatus of the present invention provides a novel and improved means for feeding a signature from the folding station into the nip of the pair of converging signature folding and feeding surfaces which fold the signature and discharge it from the folding station while overcoming the disadvantages of conventional chopper blade feeds.

In the present invention, the signature at the folding station is engaged by a pair of oppositely driven signature feeding surfaces which engage the signature at spaced apart points and feed the intermediate span of the signature into the pair of converging signature folding and feeding surfaces which fold the signature and discharge it from the folding station. The intermediate span of the signature is buckled and gradually fed into the nip between the pair of oppositely driven signature folding and feeding surfaces without causing damage to the signature. Moreover, since the leading edge of the signature is introduced into the nip while the trailing portions of the signature are still engaged and fed by the pair of oppositely driven signature feeding surfaces, there is no tendency of the trailing ends of the signature to overtake the leading folded edge.

In a preferred embodiment of the folding apparatus of the present invention the said pair of oppositely driven signature feeding surfaces includes a pair of rotors driven in opposite directions on a common shaft and carrying signature engaging and feeding means for engaging spaced apart surfaces of a signature at the folding station and feeding the intermediate span of the signature into the nip of the pair of converging folding and feeding surfaces. The oppositely driven rotors can be mounted for rotation on a common axis or on eccentric axes. Each of the rotors carries a buckle prevention surface in advance of the signature engaging and feeding surface so that the intermediate span of the signature is directed between the pair of signature folding and feeding surfaces and prevented from buckling in the wrong direction.

In a further preferred embodiment of the folding apparatus, the signature fed to the folding station is engaged by a pair of oppositely driven braking and feeding surfaces, which are located outwardly of and cooperate with the inner oppositely driven signature feeding surfaces. These oppositely driven braking and feeding surfaces stop the signatures in registered position in the folding station and then feed the outer or trailing ends inwardly toward the pair of converging signature folding and feeding surfaces. These braking and feeding surfaces afford additional control over the trailing ends of the signature. When the trailing ends of the signature are released from the outer pair of oppositely driven braking and feeding surfaces, this control is maintained by the inner pair of oppositely driven signature feeding surfaces, which continue to feed the trailing ends of the signature until the leading edge has been folded and is being discharged from the folding station by the pair of signature folding and feeding surfaces.

BRIEF DESCRIPTION OF THE DRAWING

For a complete understanding of the present invention, reference can be made to the detailed description which follows and to the drawings in which.

DESCRIPTION OF THE PREFERRED EMBODIMENT OF THE INVENTION

Figure 1:
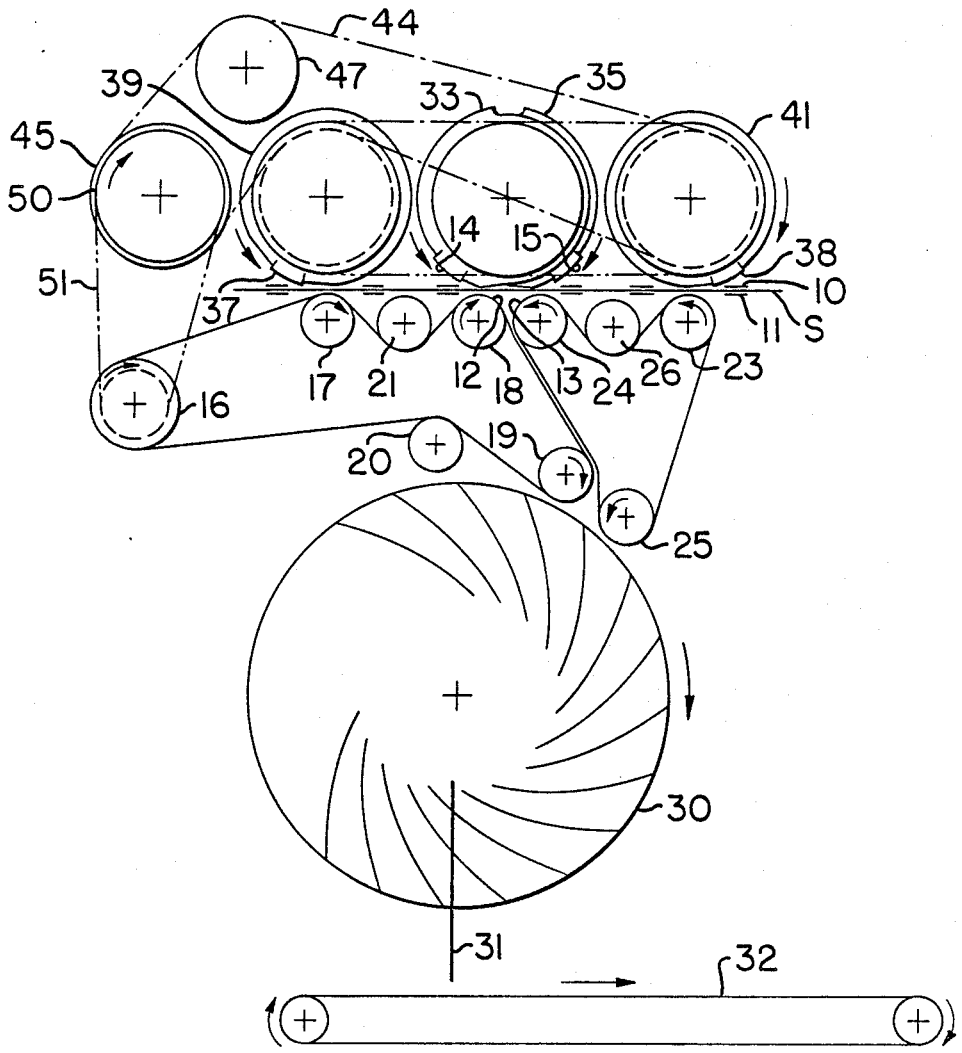
FIG. 1 is a schematic front elevational view of the folding apparatus of the present invention.
Figure 2:
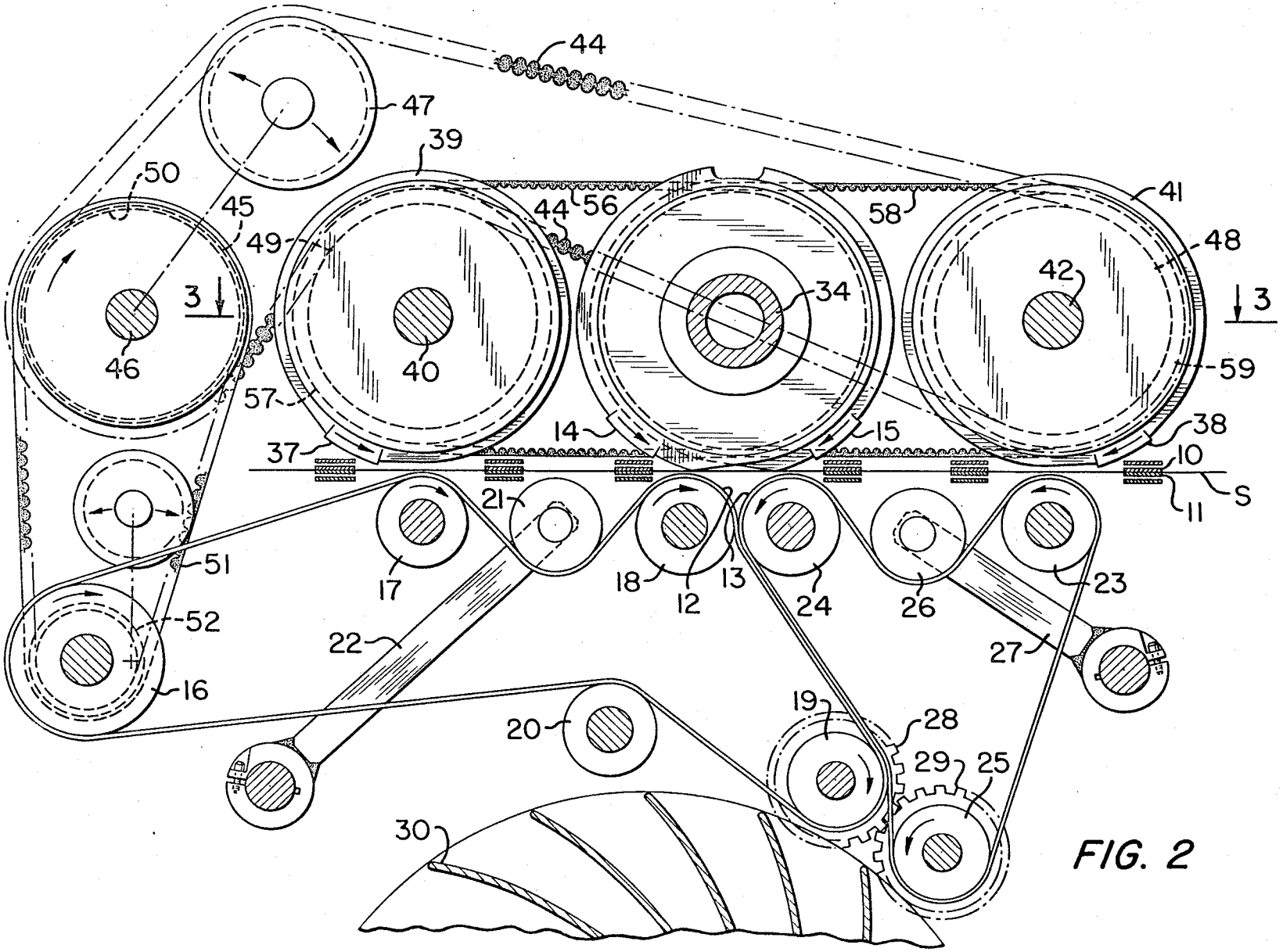
FIG. 2 is an enlarged view of part of the folding apparatus shown in FIG. 1.

In the folding apparatus of the present invention, a printed signature S to be folded is fed between upper and lower conveyor belts 10 and 11, respectively, to a folding station situated between a pair of converging signature folding and feeding surfaces 12, 13 beneath the signature and a pair of oppositely driven signature feeding surfaces 14, 15 above the signature. As shown in FIGS. 4A through 4D, the pair of oppositely driven signature feeding surfaces engage the signature at spaced apart points and feed the intermediate portion of the signature between the pair of converging signature folding and feeding surfaces 12, 13, which fold the signature and discharge it from the folding station.

If the signature S has been jaw folded, the signature will ordinarily be fed to the folding station by the conveyor belts 10, 11, with the jaw fold as the leading edge of the signature. The fold line produced by the converging folding and feeding surfaces will be perpendicular to the jaw fold.

The converging signature folding and feeding surfaces are feeding tapes 12 and 13, which are driven in separate closed paths by a drive roller 16. The tapes 12 are guided in one closed path around idler rollers 17, 18, 19 and 20. A roller 21 supported by pivotal arms 22 engages the span of the tapes 12 intermediate the idler rollers 17 and 18 to take up slack. The tapes 13 are guided in a separate closed path around idler rollers 23, 24 and 25. A roller 26 supported by pivotal arms 27 engages the span of the tapes 13 intermediate the idler rollers 23 and 24 to take up slack. The drive is transmitted from the tapes 12 to the tapes 13 by a gear 28 carried by the idler roller 19, which meshes with a gear 29 carried by the idler roller 25. If desired, the tapes can be recessed in the rollers 18, 24 so that the rollers will function as the conveying signature folding and feeding surfaces.

As shown in FIG. 1, the pair of oppositely driven signature feeding surfaces 14, 15 engage the signature at spaced apart points and feed the intermediate portion of the signature between the converging signature folding and feeding tapes 12, 13. As the intermediate span of the signature is gradually buckled and fed into the nip defined by the surfaces of the tapes 12, 13, the signature is folded and carried from the folding station between parallel spans of the tapes to a collector fan wheel 30. The signatures are discharged from the collector fan wheel by a stripper 31 onto a conveyor 32 for further processing. If desired, a creasing roller (not shown) can be provided adjacent the idler roller 19 to apply additional forces between the tapes 12, 13 to provide a sharper fold line in the signature.

The signature feeding surfaces 14 are carried by a plurality of rotors 33 mounted for rotation in one direction on a shaft 34. The signature feeding surfaces 15 are carried by a plurality of rotors 35 mounted for rotation in the opposite direction on the same shaft 34. The shaft 34, as shown in FIG. 3, is mounted between a pair of frames 36.

Figure 3:
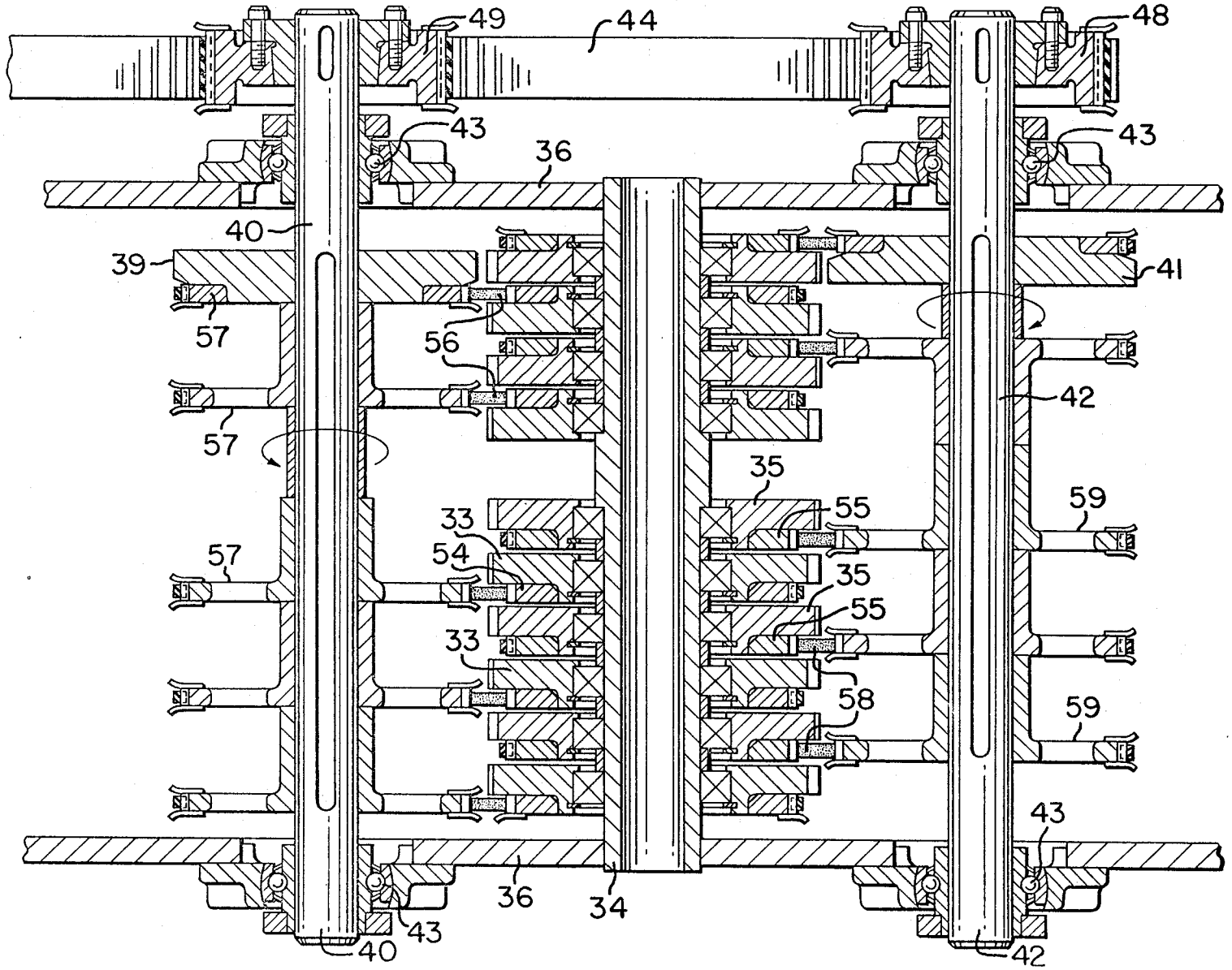
FIG. 3 is a view taken along line 3—3 of FIG. 2 looking in the direction of the arrows.
Figure 4A:
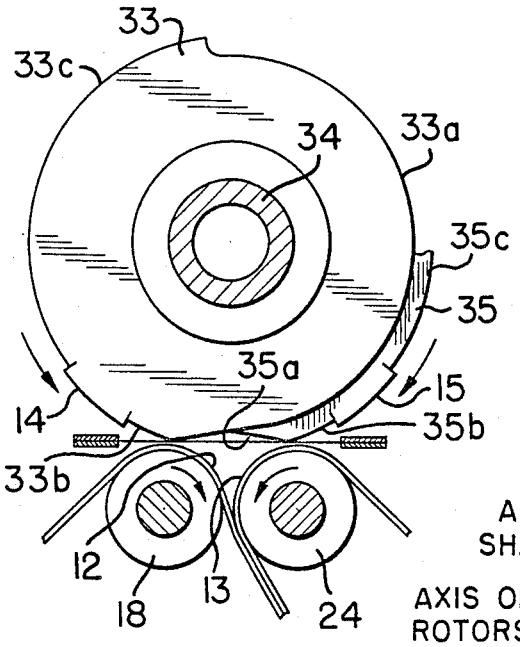
FIGS. 4A, 4B, 4C and 4D are enlarged views showing the pair of oppositely driven signature feeding surfaces progressively feeding a signature between said pair of converging signature folding and feeding surfaces.
Figure 4B:
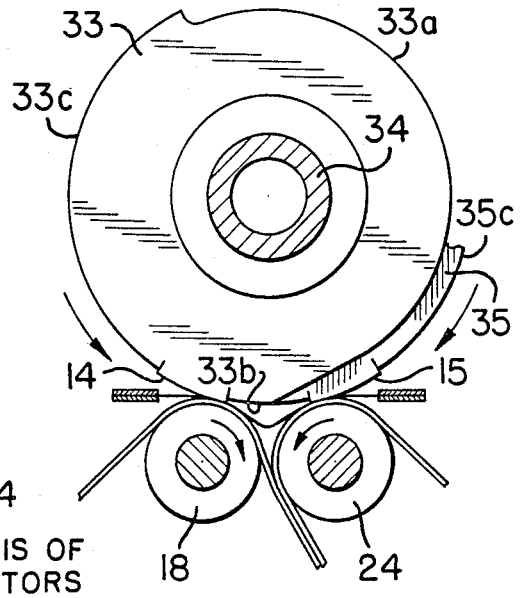
Figure 5:
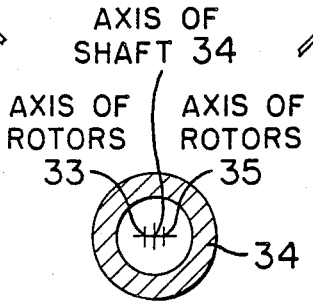
FIG. 5 is a cross-sectional view of the supporting shaft for the oppositely driven signature feeding rotors, showing eccentric axes of rotation for the rotors.

As shown in FIG. 3, the rotors 33 and 5 are arranged alternately on the shaft 34 either on a common axis or, as shown in FIG. 5, on eccentric axes. The rotors 33 are driven in synchronism in one direction and the rotors 35 are driven in synchronism in the opposite direction. As best shown in FIGS. 4A through 4D, the outer periphery of each of the rotors 33 has a recessed portion **33*a*, which does not interfere with the delivery of the signature S to the folding station by the conveyor belts 10, 11, a raised surface 33*b* in advance of the signature feeding surface 14 to prevent the reverse buckling of the signature in the wrong direction and a surface 33*c* following the signature feeding surface 14 and of approximately the same radius as the surface 33*b* to guide and prevent whipping of the trailing end of the signature as it is fed from the folding station between the converging folding and feeding tapes 12, 13. The outer periphery of each of the rotors 35 has corresponding surfaces 35*a*, 35*b* and 35*c* which perform the same functions as the corresponding surfaces of the rotors 33**.

When the signature S is fed into the folding station by the conveyor belts 10, 11, its forward advance is stopped in proper registration in the folding station by the engagement of a pair of oppositely moving sheet braking and feeding surfaces 37, 38 which initially engage the signature to stop its forward advance and then cooperate with the sheet feeding surfaces 14, 15 to direct the signature between the converging folding and feeding tapes 12, 13. The signature braking and feeding surface 37 is carried by a rotor 39, mounted on a shaft 40 for rotation in one direction, and the signature braking and feeding surface 38 is carried by a rotor 41, mounted on a shaft 42 for rotation in the direction opposite from the shaft 40. The shafts 40 and 42 are mounted for rotation in bearings 43 which, in turn, are mounted to the frames 36.

The signature braking and feeding surfaces 37, 38 engage the signature at the same time as or, if preferred, slightly in advance of the engagement of the signature by the signature feed surfaces 14, 15. The signature braking and feeding surface 37 cooperates with the upper surface of the feed tapes 12 while in engagement with the idler roller 17 (or with the upper surface of the roller 17 if the feed tapes 12 are recessed therein) to stop and then feed one trailing end of the signature toward the converging spans of the folding and feeding tapes 12, 13. In the same manner, the signature braking and feeding surface 38 cooperates with the upper surface of the feed tapes 13 while in engagement with the idler roller 23 (or with the upper surface of the roller 23 if the feed tapes are recessed therein) to stop and then feed the other trailing end of the signature toward the converging spans of the folding and feeding tapes 12, 13. As soon as the signature is stopped by the braking and feeding surfaces 37, 38, the signature feeding surfaces 14, 15 begin to feed the intermediate span of the signature into the nip of the converging folding and feeding tapes 12, 13. The signature feeding surfaces 14 cooperate with the upper surfaces of the tapes 12 while in engagement with the idler roller 18 (or with the roller 18) in feeding the signatures, and the signature feeding surfaces 15 cooperate with the upper surfaces of the tapes 13 while in engagement with the roller 24 (or with the roller 24).

The shafts 40, 42 are rotated in opposite directions by a timing belt 44 driven by a sprocket 45 on a drive shaft 46. The timing belt is guided by an idler roller 47, passes around a sprocket 48 mounted on the shaft 42, engages a sprocket 49 mounted on the shaft 40 and then returns to the drive sprocket 45. The drive shaft 46 carries another sprocket 50, which drives the feed tape drive roller 16 through a timing belt 51 which engages a sprocket 52 on the drive roller 16.

The rotors 33 on the shaft 34 carry sprockets 54 through which the rotors 33 are driven in one direction, and the rotors 35 also in the shaft 34 carry sprockets 55 through which the rotors 35 are rotated in the opposite direction. The sprockets 54 of the rotors 33 are driven by belts 56 from sprockets 57 mounted on the shaft 40. The sprockets 55, in turn, are driven by belts 58 from sprockets 59 mounted on the rotatable shaft 42.

In the operation of the folding apparatus, the signature S is fed to the folding station by the conveyor belts 10, 11, and the recessed surfaces **33*a*, 35*a* of the rotors 33, 35, respectively, and the recessed surfaces of the rotors 39, 41 provide a passage for the incoming signature and do not interfere with its entry into the folding station. At the appropriate time the braking and feeding surfaces 37, 38 of the rotors 39, 41, respectively, will engage and stop the signature in a registered position in the folding station, the position shown in FIG. 4A. The signature feeding surfaces 14, 15 may be timed to cooperate with the braking and feeding surfaces in stopping the incoming signature or to engage and feed the signature after it has been stopped. In either case, as shown in FIG. 4B, the signature feeding surfaces 14, 15 will cooperate with the braking and feeding surfaces 37, 38 to feed and buckle the signature into the nip of the converging folding and feeding surfaces of the tapes 12, 13 and/or the rollers 18, 24. The oppositely moving feeding surfaces 14, 15 direct the leading folded edge of the signature at approximately the same velocity as the tapes 12, 13, while the trailing ends of the signature are being advanced to approximately the same velocity by the braking and feeding surfaces 37, 38. At this time the buckle prevention surfaces 33*b* and 35*b*** are directly above the signature to prevent the signature from buckling in the wrong direction.

Figure 4C:
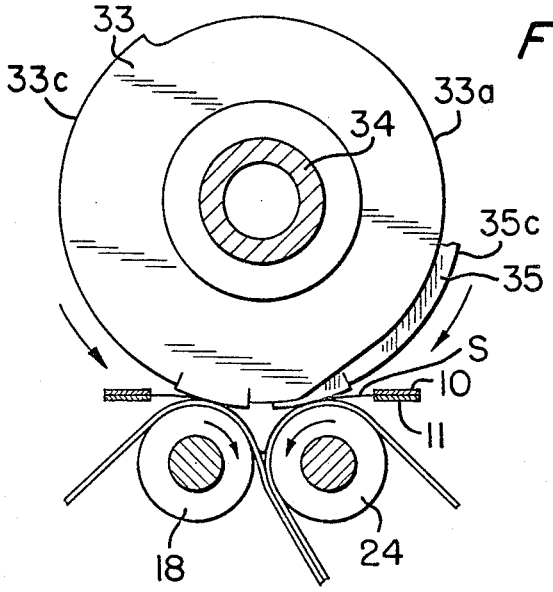
Figure 4D:
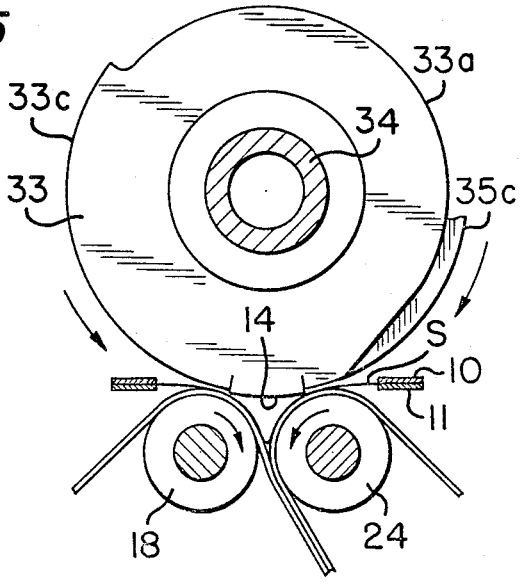

The signature is gradually fed between the converging tapes 12, 13, which fold the signature and feed the leading edge of the signature to discharge it from the folding station as shown in FIG. 4C. As the tapes 12, 13 take over the feed of the folded signature away from the folding station, the braking and feeding surfaces 37, 38, which have heretofore controlled the feed of the trailing ends of the signature, release the trailing ends of the signature, but the control of the feed of the trailing ends is taken over by the signature feeding surfaces 14, 15. As shown in FIG. 4D, the signature feeding surfaces 14, 15 disengage from the signature when the discharge of the signature from the folding station has been completely taken over by the tapes 12, 13. Nevertheless, the trailing ends of the signature are guided and prevented from whipping by the guiding surfaces **33*c*, 35*c* of the rotors 33, 35**, respectively.

The folding apparatus of the present invention produces accurate and precise folds because the signature is stopped and located in the folding station, and from the outset the signature is under the control of the braking and feeding surfaces 37, 38 and then under the control of the feeding surfaces 14, 15, so that shifting of the registered signature relative to the folding station is prevented. The leading edge of the signature is fed gradually into the nip of the converging folding and feeding tapes 12, 13, at the same velocity, while the trailing ends are controlled and advanced at about the same velocity to prevent damage to the signature. There are no critical design or adjustment problems inherent in the folding apparatus of the present invention, and higher speeds can be achieved without damage to the signature by reason of the elimination of the reliance on a massive reciprocating chopper blade feed.

The invention has been shown and described in a single preferred form and by way of example, and many variations and modifications are possible within the spirit of the invention. The invention is not intended to be limited to any specific form or embodiment, except insofar as such limitations are specified in the appended claims.

I claim:

1. A folding apparatus comprising a pair of signature folding and feeding surfaces moving in converging paths for receiving an intermediate span of a signature of a folding station, a pair of oppositely driven signature feeding rotors having raised and recessed surfaces around their outer peripheries, the raised surfaces being engagable with the signature at spaced apart points to buckle said intermediate span of the signature into the pair of converging signature folding and feeding surfaces, said signature folding and feeding surfaces folding the signature and discharging it from the folding station and means for feeding the signature to the folding station between the signature folding and feeding surfaces and the recessed surfaces of the rotors and in a direction transverse to the directions of movement of the folding and feeding surfaces and the raised surfaces of the pair of rotors and with the intermediate span prelocated with respect to the converging paths.

2. A folding apparatus as set forth in claim 1 including buckle prevention surfaces on the outer surfaces of the rotors intermediate the trailing ends of the recessed surfaces and the leading ends of the raised surfaces, said buckle prevention surfaces being recessed with respect to the raised surfaces and raised with respect to the recessed surfaces, said buckle prevention surfaces preventing the intermediate span of the signature from buckling away from said converging signature folding and feeding means.

3. A folding apparatus as set forth in claim 1 in which said pair of converging signature folding and feeding surfaces includes a pair of driven tapes, each guided in a closed path which paths converge to receive the intermediate span of the signature and to fold the signature, said converging tapes continuing in a parallel span for discharging the folded signature from the folding station.

4. A folding apparatus as set forth in claim 1 including a pair of spaced apart drive shafts driven in opposite directions and a common intermediate shaft for said pair of rotors and including means connecting one of the drive shafts to drive one of said pair of rotors and means connecting the other of said drive shafts to drive the other of said rotors.

5. A folding apparatus as set forth in claim 1 in which said rotors rotate on a common axis of a common shaft.

6. A folding apparatus as set forth in claim 1 in which said rotors rotate on eccentric axis of a common shaft.

7. A folding apparatus comprising a pair of a signature folding and feeding surfaces moving a converging paths for receiving an intermediate span of a signature at a folding station, a pair of oppositely driven signature feeding surfaces engageable with the signature at spaced apart points to buckle said intermediate span of the signature into the pair of converging signature folding and feeding surfaces, said signature folding and feeding surfaces folding the signature and discharging it from the folding station, means for feeding the signature to the folding station in a direction transverse to the directions of movement of the folding and feeding surfaces and the pair of signature feeding surfaces and with the intermediate span prelocated with respect to the converging paths, and a further pair of oppositely driven signature feeding means cooperating with the said pair of oppositely driven signature feeding surfaces and with portions of the signature folding and feeding surfaces to feed the portions of the signature remote from the intermediate span towards the converging paths and to direct the intermediate span of the signature into the pair of converging signature folding and feeding surfaces.

8. A folding apparatus comprising a pair of signature folding and feeding surfaces moving in converging paths for receiving an intermediate span of a signature at a folding station, a pair of oppositely driven signature feeding surfaces engageable with the signature at spaced apart points to buckle said intermediate span of the signature into the pair of converging signature folding and feeding surfaces, said signature folding and feeding surfaces folding the signature and discharging it form the folding station, means for feeding the signature to the folding station in a direction transverse to the direction of movement of the folding and feeding surfaces and the pair of signature feeding surfaces and with the intermediate span prelocated with respect to the converging paths, and a pair of oppositely driven signature braking and feeding surfaces which stop the signature in proper registration in the folding station and then cooperate with said pair of oppositely driven signature feeding surfaces to feed the signature into the pair of converging folding and feeding surfaces.

9. A folding apparatus as set forth in claim 8 in which the pair of signature feeding surfaces are located inwardly of said pair of signature braking and feeding surfaces so that the latter feed the trailing ends of the signature while the former feed the signature to buckle the leading end.

10. A folding apparatus comprising a pair of signature folding and feeding surfaces moving in converging paths for receiving an intermediate span of a signature at a folding station, a pair of oppositely driven signature feeding surfaces engageable with the signature at spaced apart points to buckle said intermediate span of the signature into the pair of converging signature folding and feeding surfaces, said signature folding and feeding surfaces folding the signature and discharging it from the folding station, means for feeding the signature to the folding station in a direction transverse to the direction of movement of the folding and feeding surfaces and the pair of signature feeding surfaces and with the intermediate span prelocated with respect to the converging paths, and a pair of rotors spaced apart and rotatable in opposite directions on parallel axes, and a signature braking and feeding surface carried by each rotor, said braking and feeding surfaces being engageable with the signature for stopping the signature at the folding station and then cooperating with said pair of oppositely driven signature feeding surfaces to feed the intermediate span of the signature between said pair of converging signature folding and feeding surfaces.

11. A folding apparatus as set forth in claim 10 including at least a pair of rotors driven in opposite directions on a common shaft intermediate said parallel axes and in which said pair of rotors on said common shaft are driven in opposite directions, said pair of oppositely driven rotors on the common shaft carrying said oppositely driven signature feeding surfaces and cooperating with said braking and feeding surfaces to feed the intermediate span of the signature into the pair of converging signature folding and feeding surfaces.

12. A folding apparatus comprising a pair of driven tapes, each guided in a closed path which paths converge to receive an intermediate span of a signature at a folding station and to fold the signature, said converging tapes continuing in a parallel span for discharging the folded signature from the folding station, and a pair of oppositely driven signature feeding rotors driven in opposite directions having feeding surfaces engageable with the signature at spaced apart points to buckle said intermediate span of the signature into the pair of converging tapes and recessed surfaces to permit entry of the signature to the folding station, said tapes cooperating with the feeding surfaces of said pair of oppositely driven rotors to feed said intermediate span of the signature into the converging paths of the tapes.

13. A folding apparatus comprising a pair of converging signature folding and feeding surfaces for receiving the intermediate span of a signature at a folding station, a plurality of rotors on a common shaft, each carrying a signature feeding surface and a recessed surface, means for driving alternately spaced rotors in one direction and alternately spaced rotors in the opposite direction, said recessed surfaces of the rotors permitting the feed of a signature to the folding station and said signature feeding surfaces of the rotors being engageable with the signature at spaced apart points and cooperating with the pair of converging signature folding and feeding surfaces to buckle said intermediate span of the signature at the folding station into the pair of converging signature folding and feeding surfaces, and signature folding and feeding surfaces feeding the signature and discharge it from the folding station.

* * * * *